US011898336B2

(12) United States Patent
Huang et al.

(10) Patent No.: US 11,898,336 B2
(45) Date of Patent: Feb. 13, 2024

(54) DRAINAGE CONTROL DEVICE

(71) Applicant: ECO (XIAMEN) TECHNOLOGY INC., Fujian (CN)

(72) Inventors: Bingxing Huang, Xiamen (CN); Dongsheng Zhang, Xiamen (CN); Shengjin Rao, Xiamen (CN)

( * ) Notice: Subject to any disclaimer, the term of this patent is extended or adjusted under 35 U.S.C. 154(b) by 0 days.

(21) Appl. No.: 17/970,589

(22) Filed: Oct. 21, 2022

(65) Prior Publication Data

US 2023/0183959 A1 Jun. 15, 2023

(30) Foreign Application Priority Data

Dec. 15, 2021 (CN) ..... 202123155945.5

(51) Int. Cl.
*E03C 1/23* (2006.01)
*E03C 1/12* (2006.01)

(52) U.S. Cl.
CPC ..... *E03C 1/23* (2013.01); *E03C 2001/1206* (2013.01)

(58) Field of Classification Search
CPC ..... E03C 1/23; E03C 2001/1206; E03D 3/00; E03D 3/02; E03D 3/10; E03D 5/09; E03D 5/10
USPC ..... 4/333, 354, 362, 378, 405–407
See application file for complete search history.

(56) References Cited

U.S. PATENT DOCUMENTS

2011/0017929 A1* 1/2011 Guler ..... E03D 3/06 251/129.01

FOREIGN PATENT DOCUMENTS

CN 108252381 A * 7/2018 ..... E03D 3/06
CN 113152609 A * 7/2021

* cited by examiner

*Primary Examiner* — Tuan N Nguyen

(57) ABSTRACT

A drainage control device includes a main body, an upper cover, a lower cover, a pressure relief cover, a membrane, and a return member. The main body has a water filling trough, a drainage trough, and a water passage trough. A drainage chamber having a drainage port is defined between the upper cover and the drainage trough. A water filling chamber has a water filling port is defined between the lower cover and the water filling trough. The pressure relief cover and the main body hold a periphery of the membrane. A water passage chamber is defined between the membrane and the water passage trough. A back-pressure chamber having a drain port is defined between the membrane and the pressure relief cover. The membrane is configured to open or close a junction of the water passage chamber and the drainage chamber. The membrane is returned by the return member.

13 Claims, 18 Drawing Sheets

DRAINAGE CONTROL DEVICE

BACKGROUND OF THE INVENTION

Field of the Invention

The present invention relates to a bathroom accessory, and more particularly to a drainage control device.

Description of the Prior Art

A conventional water split box of a pressure-assisted toilet flush system is used as an integral member for draining water and water drainage of the system. The water flow after being depressurized or drained is collected and then distributed to a primary flushing pipe and a rinsing water pipe of a toilet. That is, the conventional water split box has a single function. Most of the functional structures of the pressure-assisted toilet flush system, such as a drainage valve, are disposed in the pressure-assisted flush water tank, which results in complicated mold making of the pressure-assisted flush water tank and high cost. There are certain difficulties in product assembly, post-repair and maintenance.

SUMMARY OF THE INVENTION

The primary object of the present invention is to provide a drainage control device, which has a drainage control function and can simplify the water storage structure of a toilet flushing system. The installation is easier and the cost is lower.

In order to achieve the above object, the present invention adopts the following solutions.

A drainage control device comprises a main body, an upper cover, a lower cover, a pressure relief cover, a membrane, and a return member. The main body has a water filling trough, a drainage trough, and a water passage trough. The water filling trough and the drainage trough are in communication with the water passage trough. A drainage chamber is defined between the upper cover and the drainage trough. The drainage chamber has at least one drainage port. A water filling chamber is defined between the lower cover and the water filling trough. The water filling chamber has at least one water filling port. The pressure relief cover and the main body hold a periphery of the membrane. A water passage chamber is defined between the membrane and the water passage trough. A back-pressure chamber is defined between the membrane and the pressure relief cover. The back-pressure chamber has at least one drain port. The membrane is deformable and configured to open or close a junction of the water passage chamber and the drainage chamber as a pressure in the back-pressure chamber varies. The return member is disposed in the back-pressure chamber and configured to return the membrane to close the junction of the water passage chamber and the drainage chamber. A water supplement channel is disposed between the back-pressure chamber and the water filling chamber for the back-pressure chamber to communicate with the water filling chamber.

The upper cover has a vent for the drainage chamber to communicate with air.

The drainage control device further comprises a one-way valve assembly disposed in the vent. The one-way valve assembly is configured to open or close the vent.

The one-way valve assembly includes a movable member and a sealing member. The movable member is movably inserted in the vent. The sealing member is mounted on the movable member and configured to close the vent along with movement of the movable member.

A top of the upper cover has an overflow trough. The vent communicates with the overflow trough. An opening of the overflow trough is provided with a lid. The lid partially covers the opening of the overflow trough.

The drainage control device further comprises a movable seat for carrying the membrane. The return member is a spring disposed between the pressure relief cover and the movable seat. The pressure relief cover has an inner wall provided with an annular flange for positioning the spring.

The movable seat has its surface provided with a plurality of retaining posts. The membrane is formed with retaining holes matching the retaining post. The retaining posts are inserted and positioned in the retaining holes. The water supplement channel passes through the membrane and the movable seat.

The membrane is provided with at least one circle of deformable creases.

The at least one drain port of the back-pressure chamber includes one or two drain ports. For example, the back-pressure chamber has two drain ports, the two drain ports are defined as a first drain outlet and a second drain outlet respectively, the first drain outlet is controlled by a switch valve, the second drain outlet is controlled by a solenoid valve; or, the back-pressure chamber has only one drain port g, the drain port is defined as a first drain outlet, the first drain outlet is controlled by the switch valve; or, the back-pressure chamber has only one drain port, the drain port is defined as a second drain outlet, the second drain outlet is controlled by the solenoid valve.

Further, the second drain outlet is directly connected to the drainage chamber, and the solenoid valve is configured to control the second drain outlet to communicate with the discharge chamber or not.

With the configuration described above, in the present invention, the deformable membrane is disposed in the water passage trough to form the water passage chamber and the back-pressure chamber between the main body and the pressure relief cover. In a normal state, the pressure of the water passage chamber and the pressure of the back-pressure chamber come to balance, and the membrane closes the junction of the water passage chamber and the drainage chamber under the action of the return member. When the drain port is opened, the pressure of the back-pressure chamber decreases, and the pressure of the water passage chamber pushes the membrane to move for the water passage chamber to communicate with the drainage chamber to achieve water drainage. The present invention has a drainage control function, which can control water drainage of the device connected to the water filling port d, that is, the drainage structure of the toilet flush system is integrated into the present invention. The internal structure of the water storage structure (such as a water vessel) is simplified. The production and mold making are easier, and the cost is lower. The water filling port d and the drainage port b of the present invention can realize multi-directional communication and the functions of confluence and diversion. In addition to the above-mentioned drainage control function, a multi-functional water discharge control device is realized, with more centralized functions and convenient inspection and maintenance.

DETAILED DESCRIPTION OF THE PREFERRED EMBODIMENTS

Figure 1:
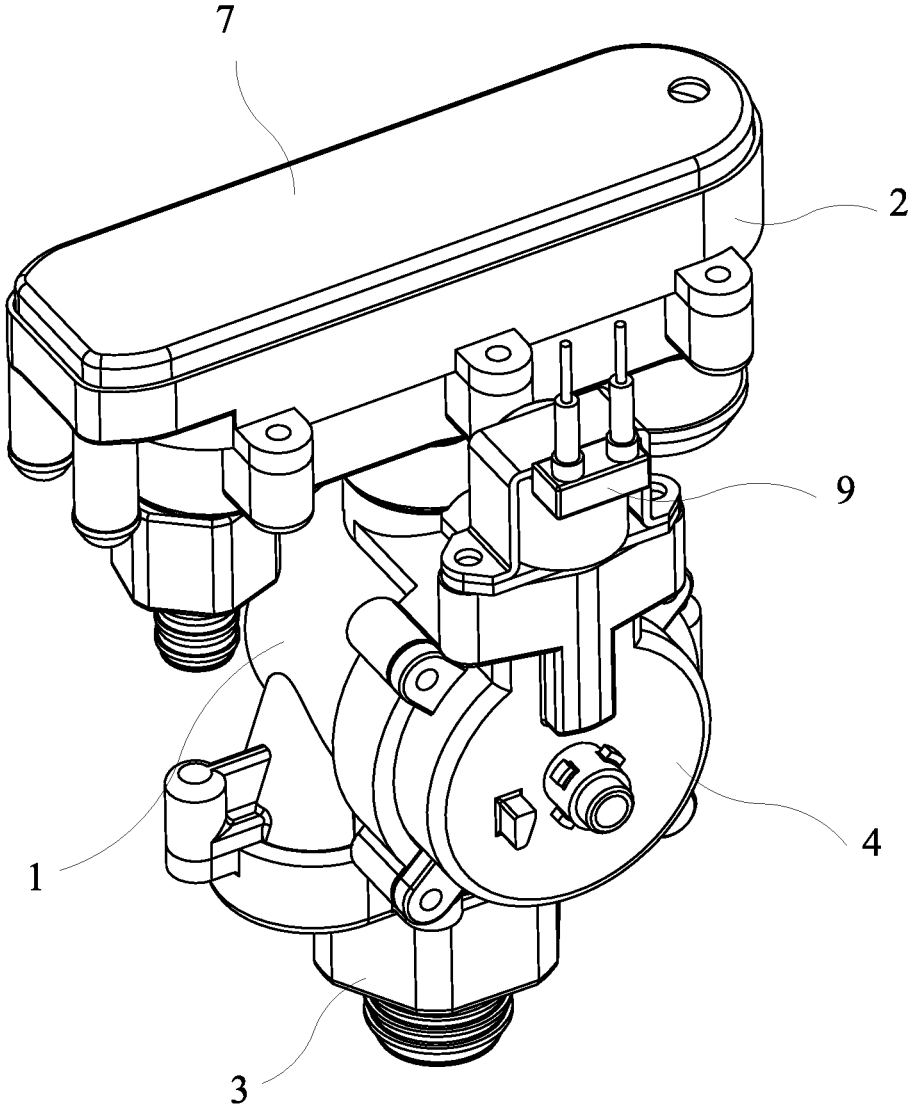
FIG. 1 is a perspective view of a first embodiment of the present invention.

Embodiments of the present invention will now be described, by way of example only, with reference to the accompanying drawings.

The present invention relates to a drainage control device, comprising a main body 1, an upper cover 2, a lower cover 3, a pressure relief cover 4, a membrane 5 and a return member 20.

The main body 1 has a water filling trough 11, a drainage trough 12, and a water passage trough 13. The water filling trough 11 and the drainage trough 12 are in communication with the water passage trough 13.

A drainage chamber a is defined between the upper cover 2 and the drainage trough 12. The drainage chamber a has at least one drainage port b.

A water filling chamber c is defined between the lower cover 3 and the water filling trough 11. The water filling chamber c has at least one water filling port d.

The pressure relief cover 4 and the main body 1 hold the periphery of the membrane 5.

A water passage chamber e is defined between the membrane 5 and the water passage trough 13. A back-pressure chamber f is defined between the membrane 5 and the pressure relief cover 4. The back-pressure chamber f has at least one drain port g. The membrane 5 is deformable and configured to open and close the junction of the water passage chamber e and the drainage chamber a as the pressure in the back-pressure chamber f varies.

The return member 20 is disposed in the back-pressure chamber f, and configured to return the membrane 5 to close the junction of the water passage chamber e and the drainage chamber a.

A water supplement channel h is disposed between the back-pressure chamber f and the water filling chamber c for the back-pressure chamber f to communicate with the water filling chamber c.

With the configuration described above, in the present invention, the deformable membrane 5 is disposed in the water passage trough 13 to form the water passage chamber e and the back-pressure chamber f between the main body 1 and the pressure relief cover 4. In a normal state, the pressure of the water passage chamber e and the pressure of the back-pressure chamber f come to balance, and the membrane 5 closes the junction of the water passage chamber e and the drainage chamber a under the action of the return member 20. When the drain port g is opened, the pressure of the back-pressure chamber f decreases, and the pressure of the water passage chamber e pushes the membrane 5 to move for the water passage chamber e to communicate with the drainage chamber a to achieve water drainage. The present invention has a drainage control function, which can control water drainage of the device connected to the water filling port d, that is, the drainage structure of the toilet flush system is integrated into the present invention. The internal structure of the water storage structure (such as a water vessel) is simplified. The production and mold making are easier, and the cost is lower. The water filling port d and the drainage port b of the present invention can realize multi-directional communication and the functions of confluence and diversion. In addition to the above-mentioned drainage control function, a multi-functional water discharge control device is realized, with more centralized functions and convenient inspection and maintenance.

In some embodiments, the upper cover 2 has a vent 21 for the drainage chamber a to communicate with the air. After the present invention finishes water drainage, air is supplemented into the drainage chamber a via the vent 21 to restore the pressure, thereby keeping the pressure balance inside the present invention.

Furthermore, the present invention further comprises a one-way valve assembly 6 disposed in the vent 21. The one-way valve assembly 6 is configured to open or close the vent 21. When the present invention performs water drainage, the one-way valve assembly 6 closes the vent 21 to prevent water from leaking from the vent 21. After the present invention finishes water drainage, the one-way valve assembly 6 opens the vent 21 for air supplement.

Furthermore, the one-way valve assembly 6 includes a movable member 61 and a sealing member 62. The movable member 61 is movably inserted in the vent 21. The sealing member 62 is mounted on the movable member 61 and configured to close the vent 21 along with movement of the movable member 61.

The top of the upper cover 2 has an overflow trough 22. The vent 21 communicates with the overflow trough 22. The overflow trough 22 is configured to temporarily store the water flowing out from the vent 21. Even if the one-way valve assembly 6 fails and the water flows out from the vent 21, the overflow trough 22 can prevent water from splashing, so as to avoid affecting the working state of other devices of the toilet flush system. In addition, the opening of the overflow trough 22 is provided with a lid 7. The lid 7 partially covers the opening of the overflow trough 22 to achieve ventilation and further prevent water from splashing.

In some embodiments, the present invention further comprises a movable seat 8 for carrying the membrane 5. The return member 20 is disposed between the pressure relief cover 4 and the movable seat 8. The movable seat 8 serves to hold the central part of the membrane 5 in shape, so as to ensure that when the membrane 5 is moved toward the drainage chamber a by the pressure of the back-pressure chamber f and the force of the return member 20, it can fully close the junction of the drainage chamber a and the water passage chamber e, thereby preventing any water leakage except for intended water drainage.

Further, the movable seat 8 has its surface provided with a plurality of retaining posts 81 and the membrane 5 is formed with retaining holes 51 matching the retaining post 81 so that the retaining posts 81 are inserted and positioned in the retaining holes 51, thereby achieving mutual positioning between the membrane 5 and the movable seat 8.

Furthermore, the water supplement channel h passes through the membrane 5 and the movable seat 8. Given the fact that the diameter of the supplement channel h is the key factor of the water flow from the water filling chamber c to the back-pressure chamber f, and the time taken by water supplement for the drainage structure can be controlled by changing the diameter of the supplement channel h, time taken by water drainage can be adjusted according to different needs. With the supplement channel h formed on the membrane 5 and the movable seat 8, it is possible to fast obtain the supplement channel h of the suitable diameter by replacing the membrane 5 and the movable seat 8, thereby saving manufacturing costs and satisfying various needs of users.

In some embodiments, the membrane 5 is provided with at least one circle of deformable creases 52. The creases 52 ensure that the membrane 5 is able to elastically deform in response to external force.

In some embodiments, the return member 20 is a spring. The pressure relief cover 4 has an inner wall provided with an annular flange 41 for positioning the spring. This helps prevent that the spring fails to return the membrane 5 due to any positional change happening during compression/restoration of the spring.

In some embodiments, the at least one drain port g may include one or two drain ports. For example, the back-pressure chamber f has two drain ports g, the two drain ports g are defined as a first drain outlet i and a second drain outlet j respectively, the first drain outlet i is controlled by a switch valve 30 of the pressure-assisted toilet flush system, the second drain outlet j is controlled by a solenoid valve 9 of the pressure-assisted toilet flush system; or, the back-pressure chamber f has only one drain port g, the drain port g is defined as a first drain outlet i, the first drain outlet i is controlled by the switch valve 30; or, the back-pressure chamber f has only one drain port g, the drain port g is defined as a second drain outlet j, the second drain outlet j is controlled by the solenoid valve 9. When there is only one drain port g, the manual or electric switch control mode of the present invention can be realized, that is, manual or electric drainage can be realized. When there are two drain ports g, the present invention can realize the manual and electric switch control mode. The switch valve 30 is a common mechanical drainage mechanism in the pressure-assisted toilet flush system. The switch valve 30 is in communication with the first drain outlet i through a water pipe 40. The switch valve 30 is generally opened by pressing manually. When the user presses the switch valve 30, the switch valve 30 is opened and the first drain outlet i is opened to realize water drainage of the back-pressure chamber f.

Further, when the present invention has the second drain outlet j and the solenoid valve 9, the second drain outlet j may be directly connected to the drainage chamber a. The solenoid valve 9 is configured to control the second drain outlet j to communicate with the discharge chamber a or not, that is, the depressurized water flow is directly used to flush the toilet to avoid waste.

In some embodiments, the drainage port b may be disposed on the main body 1 or the upper cover 2. The water filling port d may be disposed on the main body 1 or the lower cover 3. The drain port g may be disposed on the main body 1 or the pressure relief cover 4. The adaptability of the present invention to different toilet flush systems can be adjusted by replacing a different main body 1/upper cover 2/lower cover 3/pressure relief cover 4 (mainly adapting to the connection of different numbers of water filling pipes and water discharge pipes).

In addition, in the drainage control device provided by the present invention, some sealing rings/gaskets are disposed at the junction of some components to prevent water leakage, which will not be repeated hereinafter.

Three embodiments of the present invention are described below.

Figure 2:
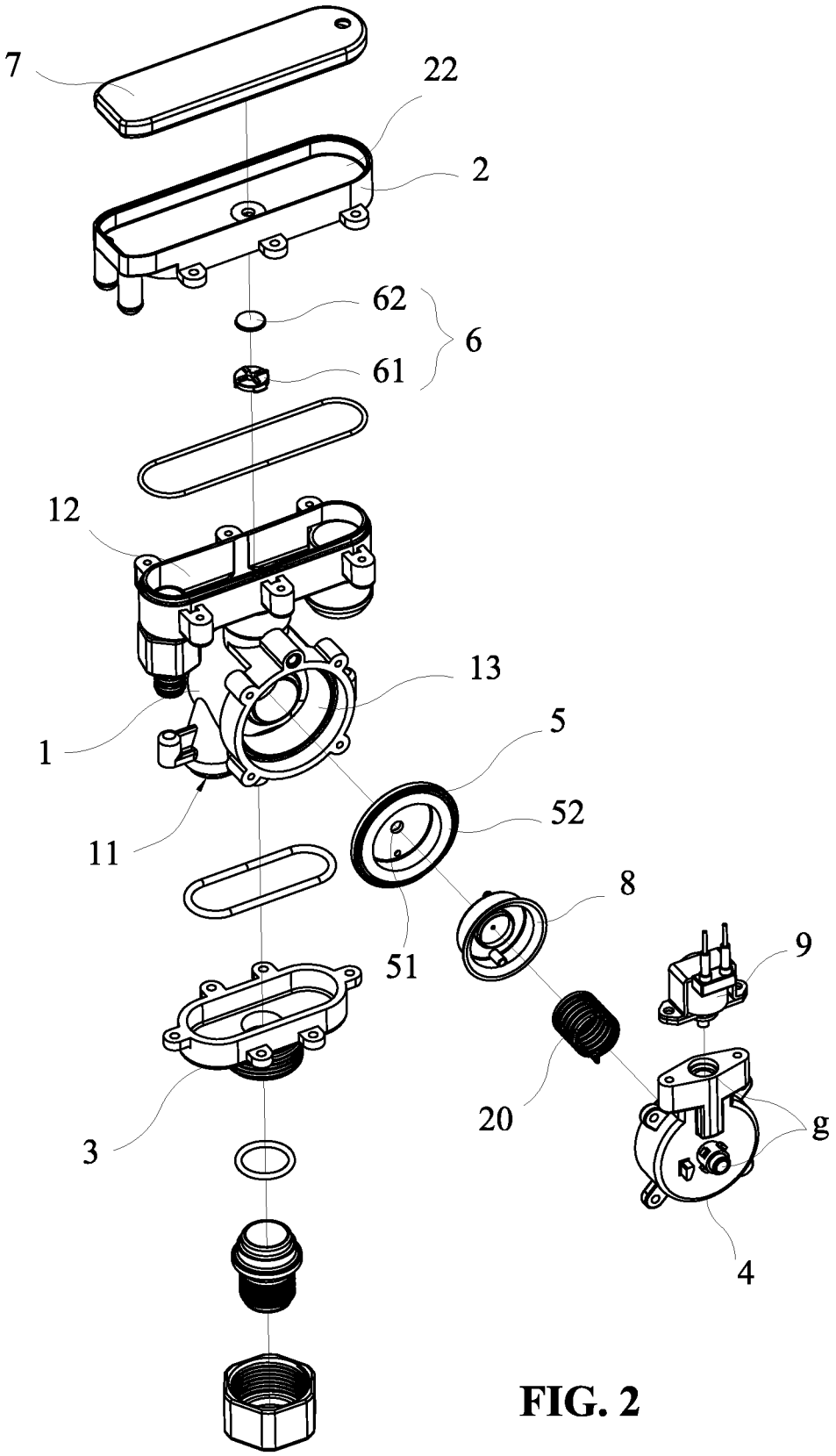
FIG. 2 is an exploded view of the first embodiment of the present invention.
Figure 3:
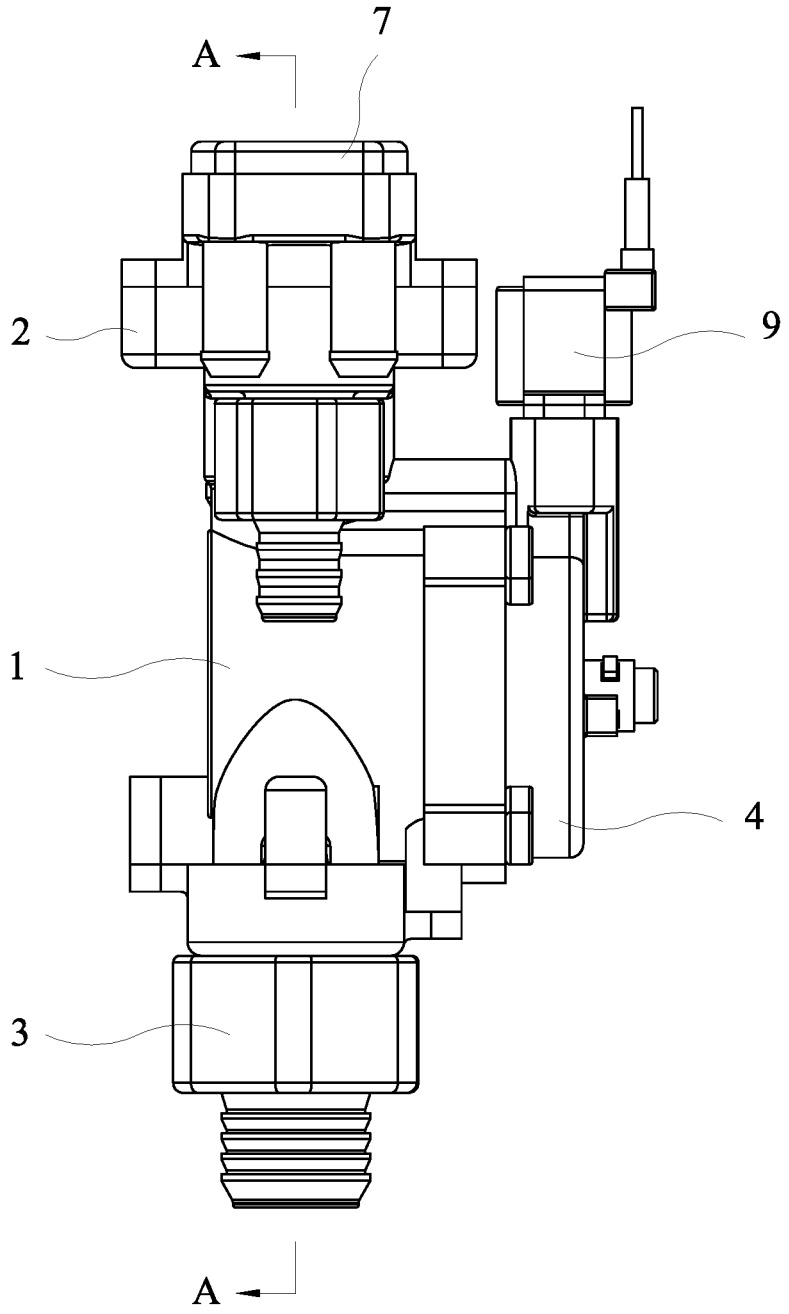
FIG. 3 is a side view of the first embodiment of the present invention.
Figure 4:
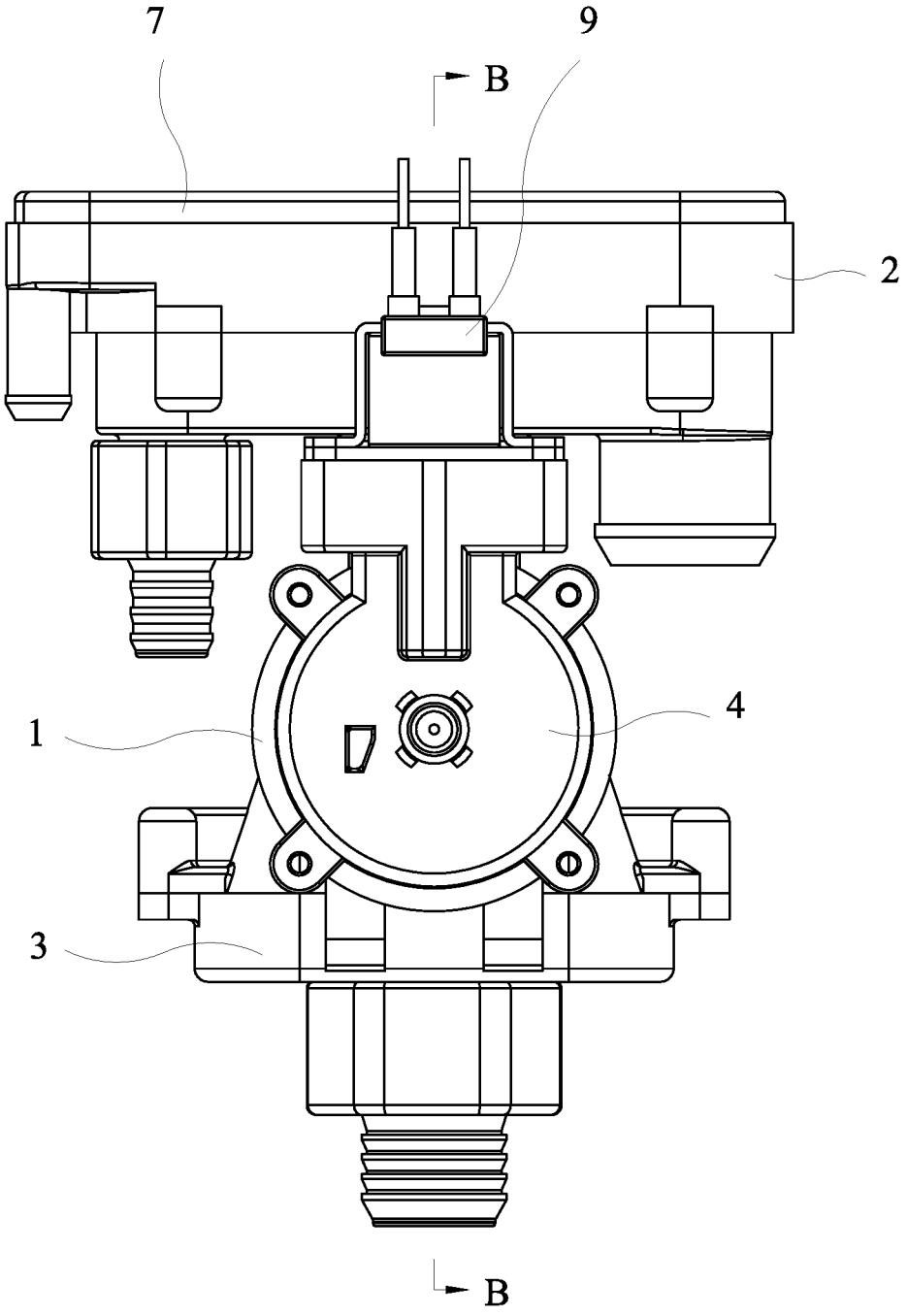
FIG. 4 is a front view of the first embodiment of the present invention.
Figure 5:
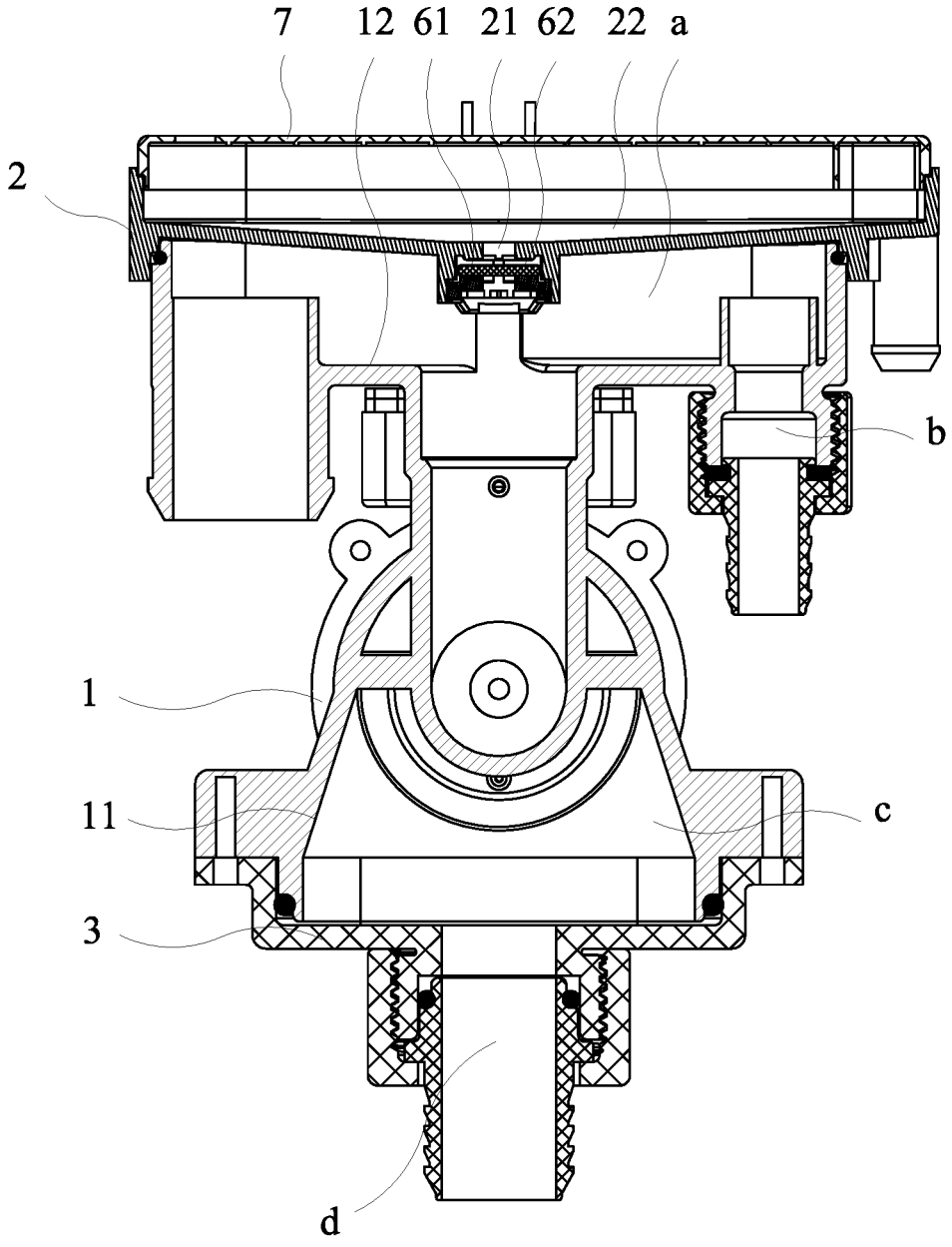
FIG. 5 is a cross-sectional view taken along line A-A of FIG. 3.
Figure 6:
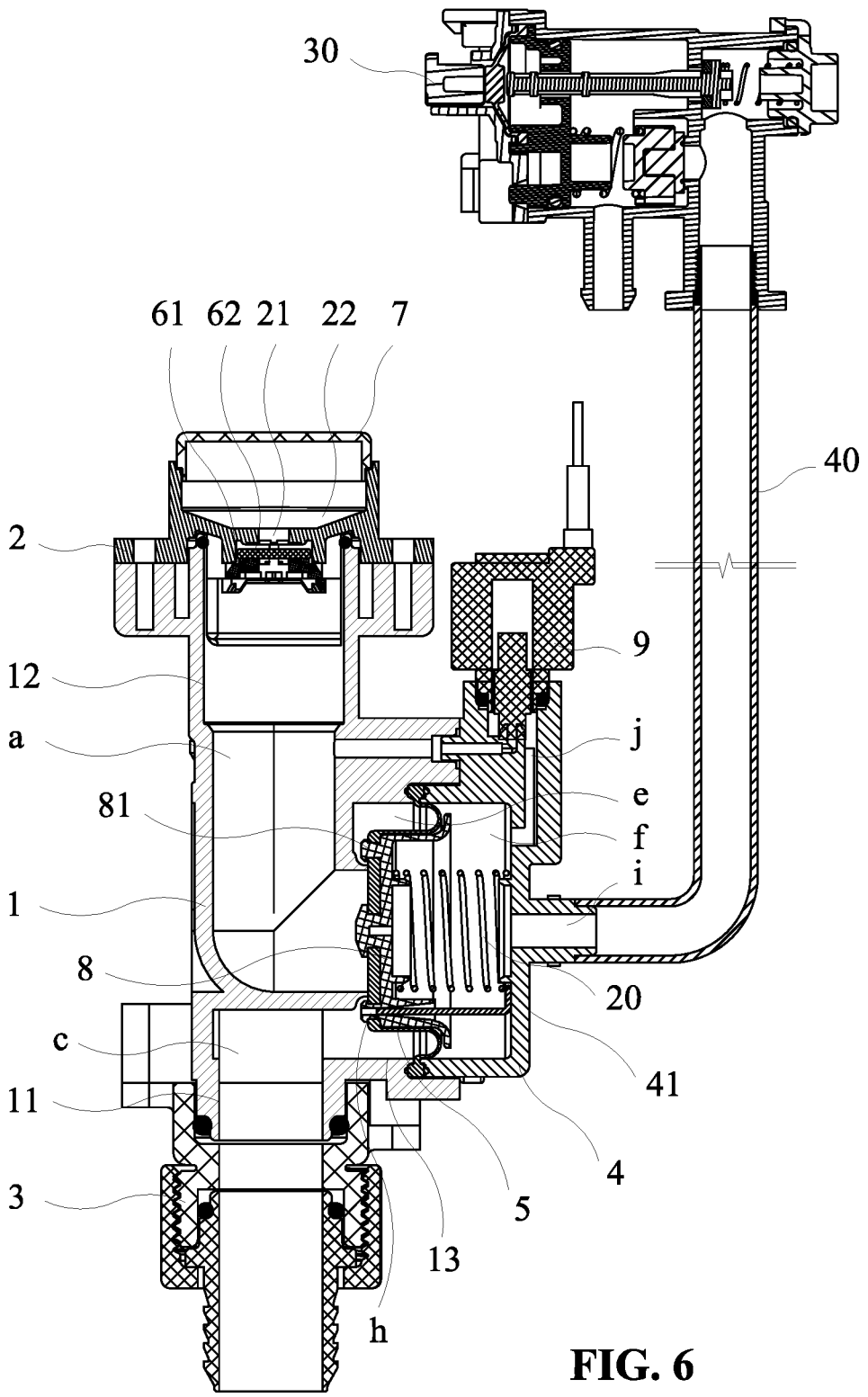
FIG. 6 is a cross-sectional view taken along line B-B of FIG. 4.

Referring to FIGS. 1 to 6, a first embodiment of the present invention is shown.

In the first embodiment, two drainage ports b are disposed on the main body 1; one water filling port d is disposed on the lower cover 3; two drain ports g are disposed on the pressure relief cover 4. The two drain ports g are defined as a first drain outlet i and a second drain outlet j, and are controlled by the switch valve 30 and the solenoid valve 9 of the pressure-assisted toilet flush system, respectively.

Figure 7:
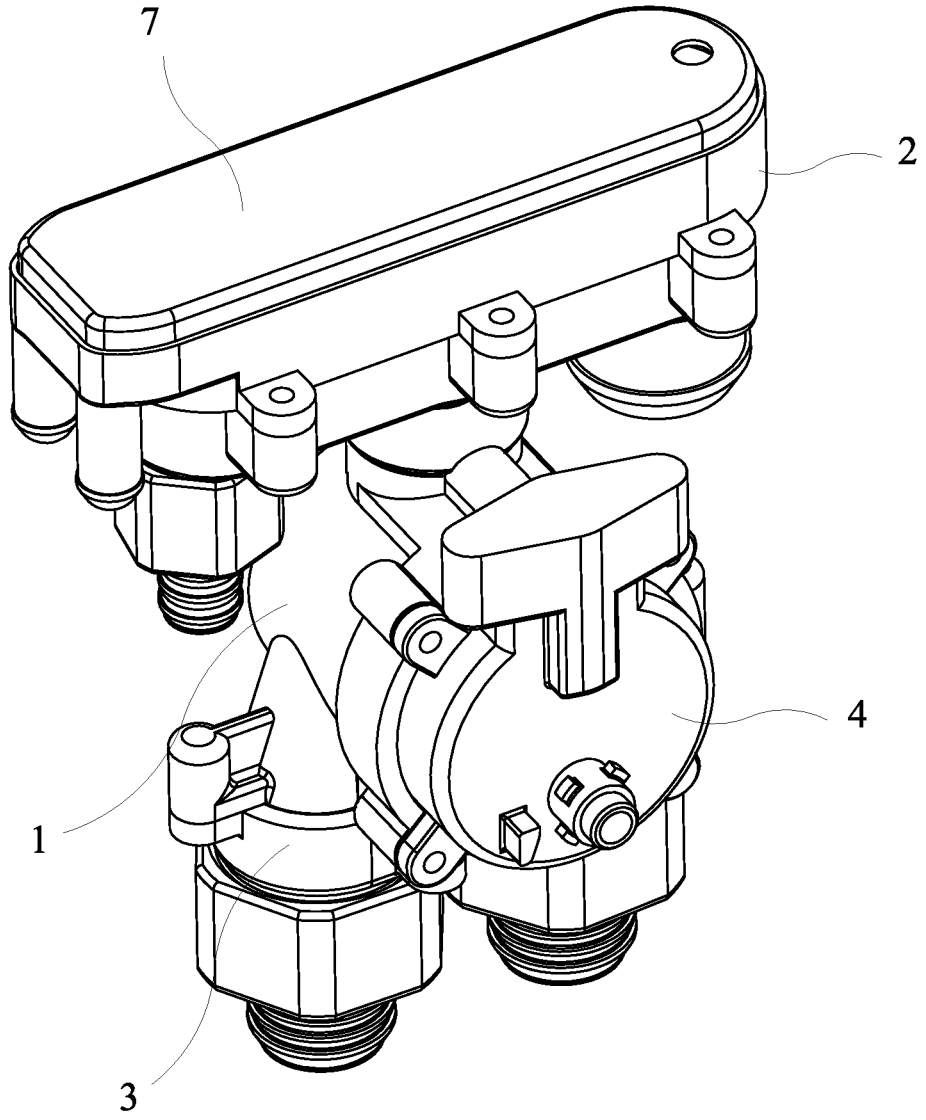
FIG. 7 is a perspective view of a second embodiment of the present invention.
Figure 8:
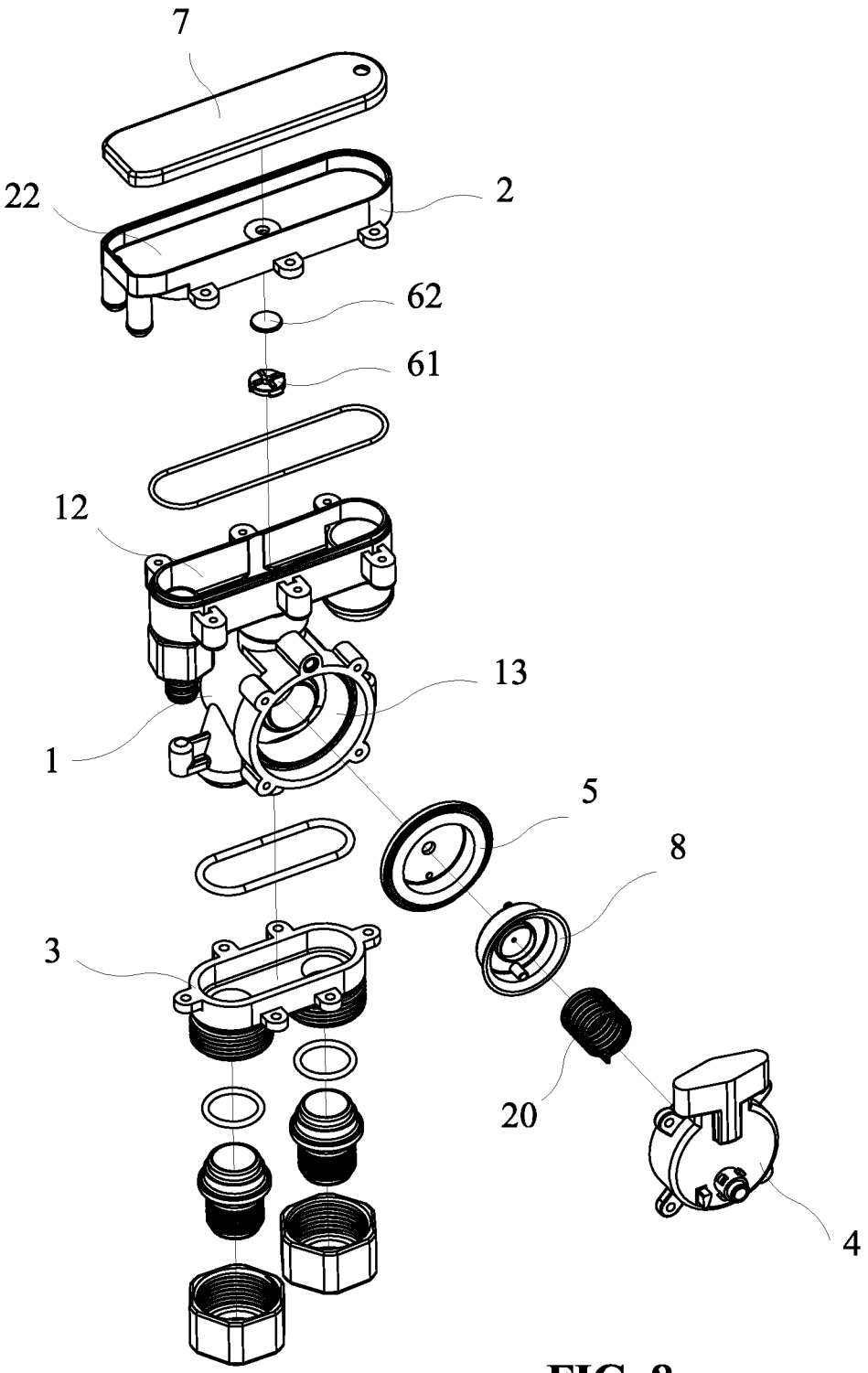
FIG. 8 is an exploded view of the second embodiment of the present invention.
Figure 9:
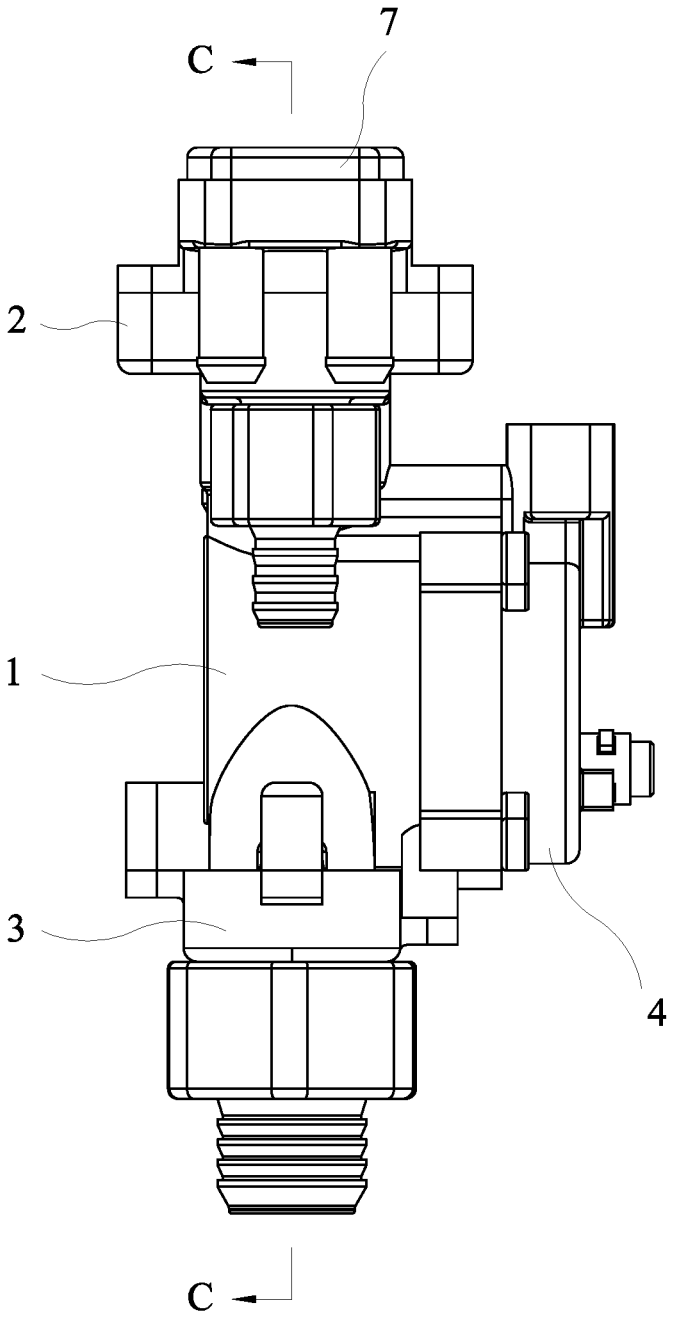
FIG. 9 is a side view of the second embodiment of the present invention.
Figure 10:
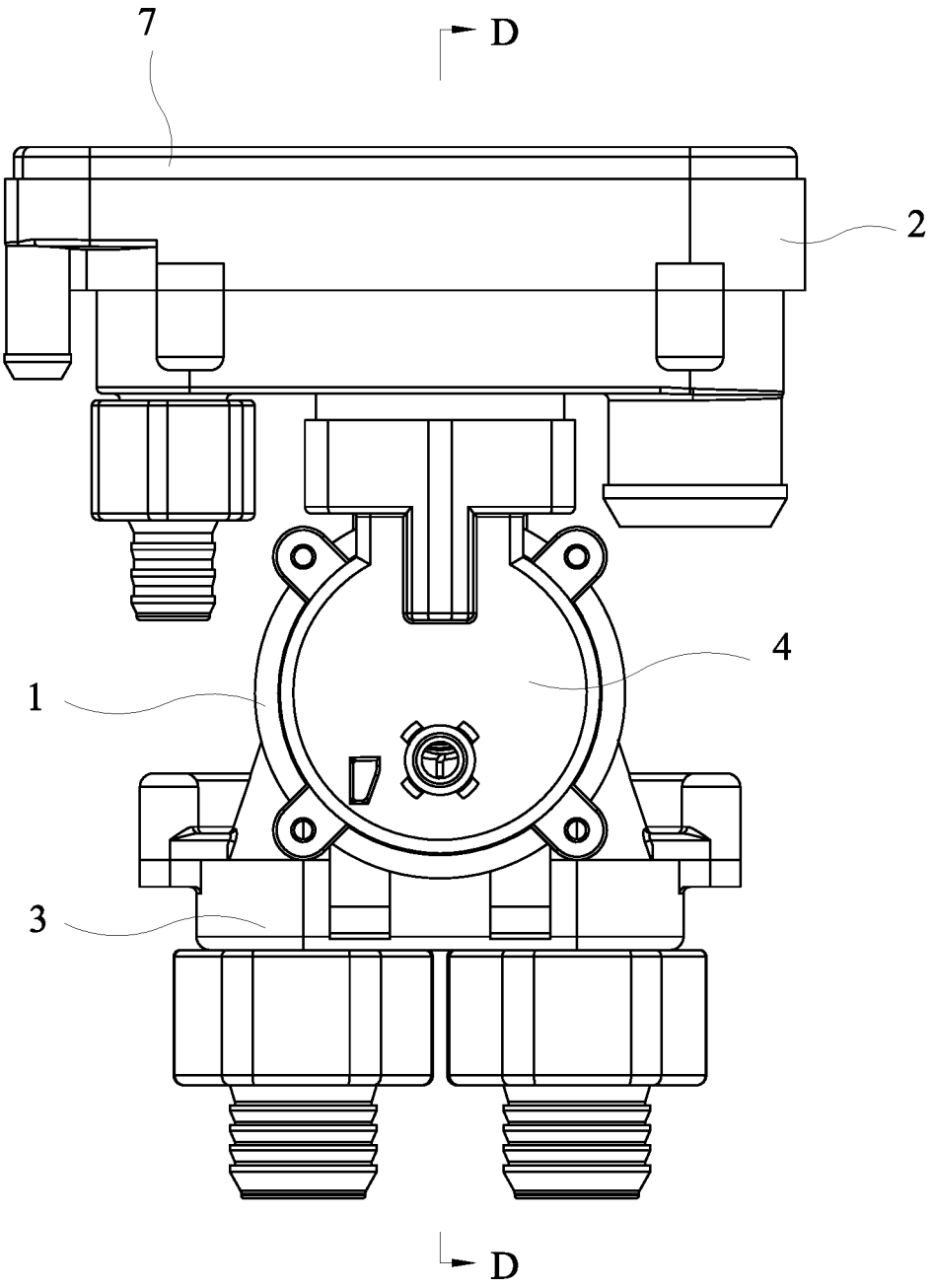
FIG. 10 is a front view of the second embodiment of the present invention.
Figure 11:
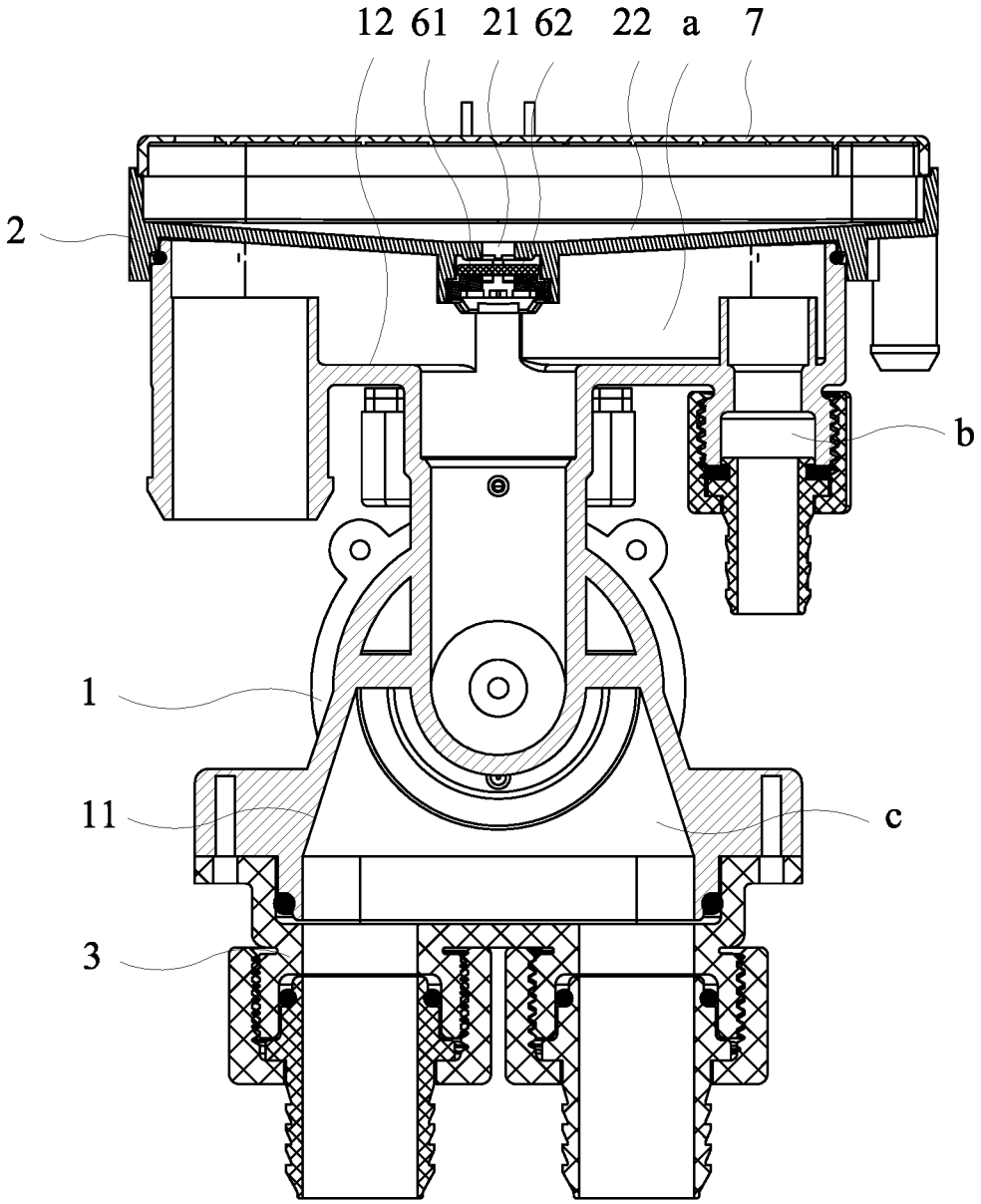
FIG. 11 is a cross-sectional view taken along line C-C of FIG. 9.
Figure 12:
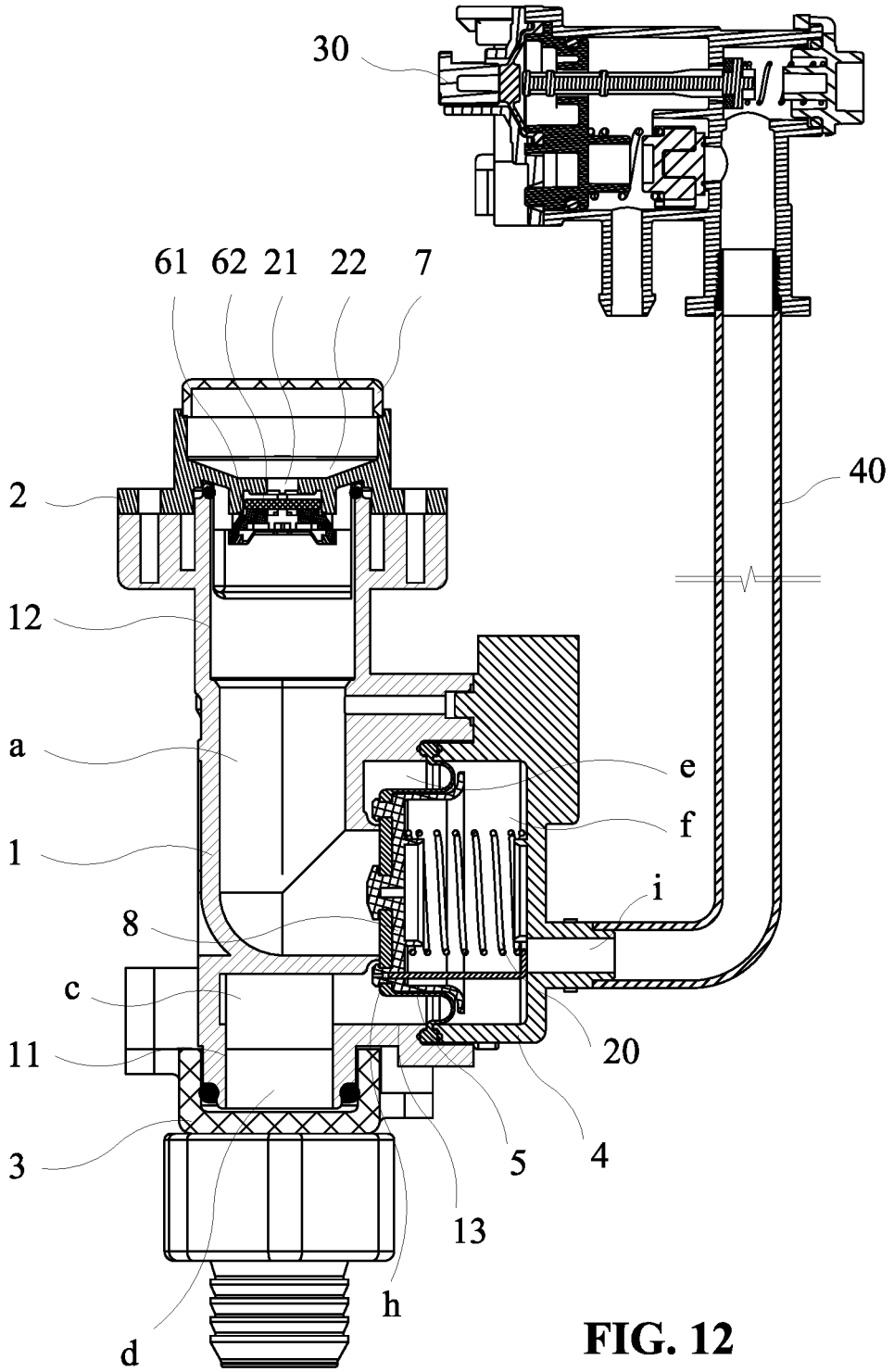
FIG. 12 is a cross-sectional view taken along line D-D of FIG. 10.

Referring to FIGS. 7 to 12, a second embodiment of the present invention is shown.

In the second embodiment, two drainage ports b are disposed on the main body 1; two water filling ports d are disposed on the lower cover 3; only one drain port g defined as a first drain outlet i is disposed on the pressure relief cover 4. The first drain outlet i is controlled by the switch valve 30 of the pressure-assisted toilet flush system.

Figure 13:
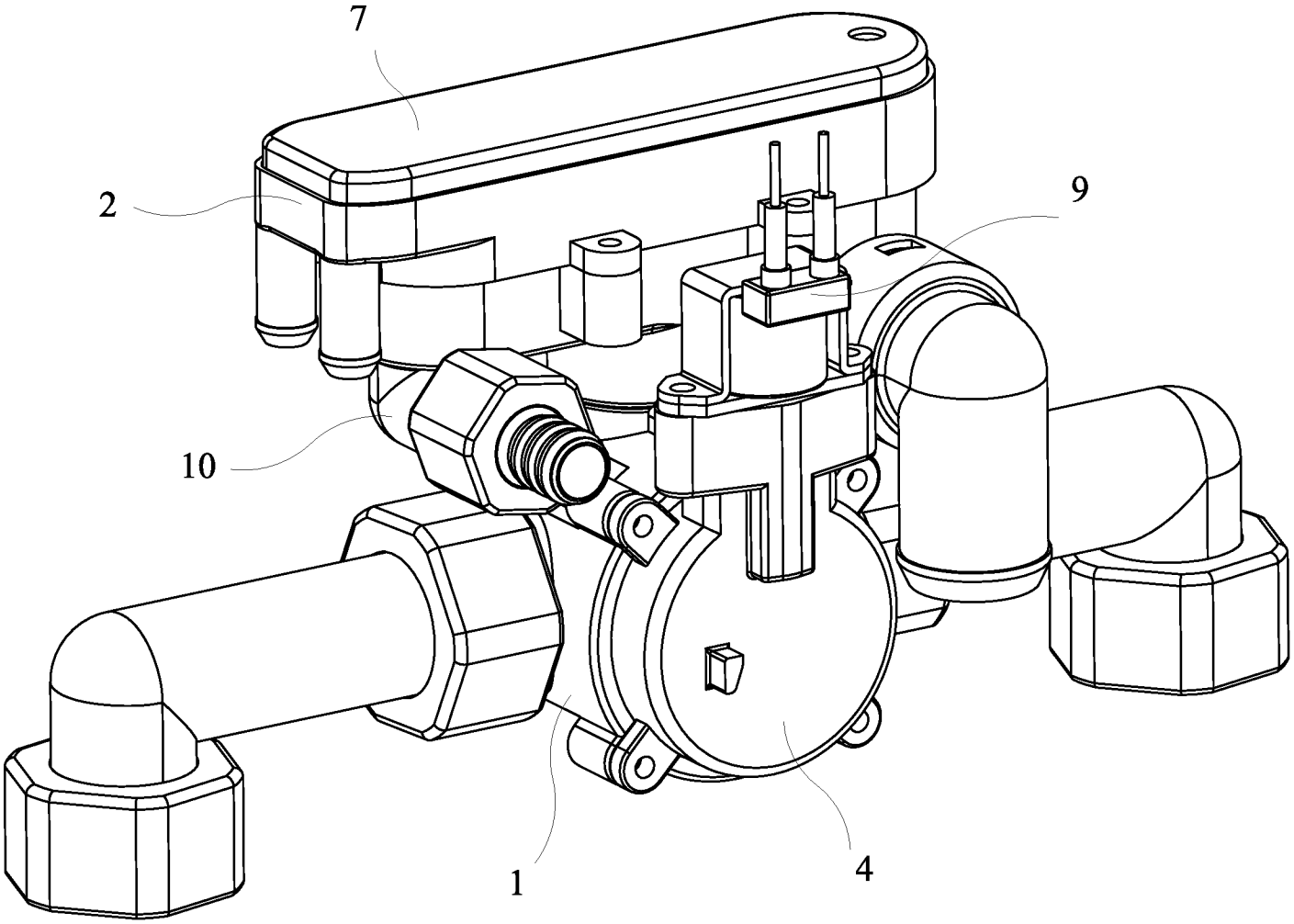
FIG. 13 is a perspective view of a third embodiment of the present invention.
Figure 14:
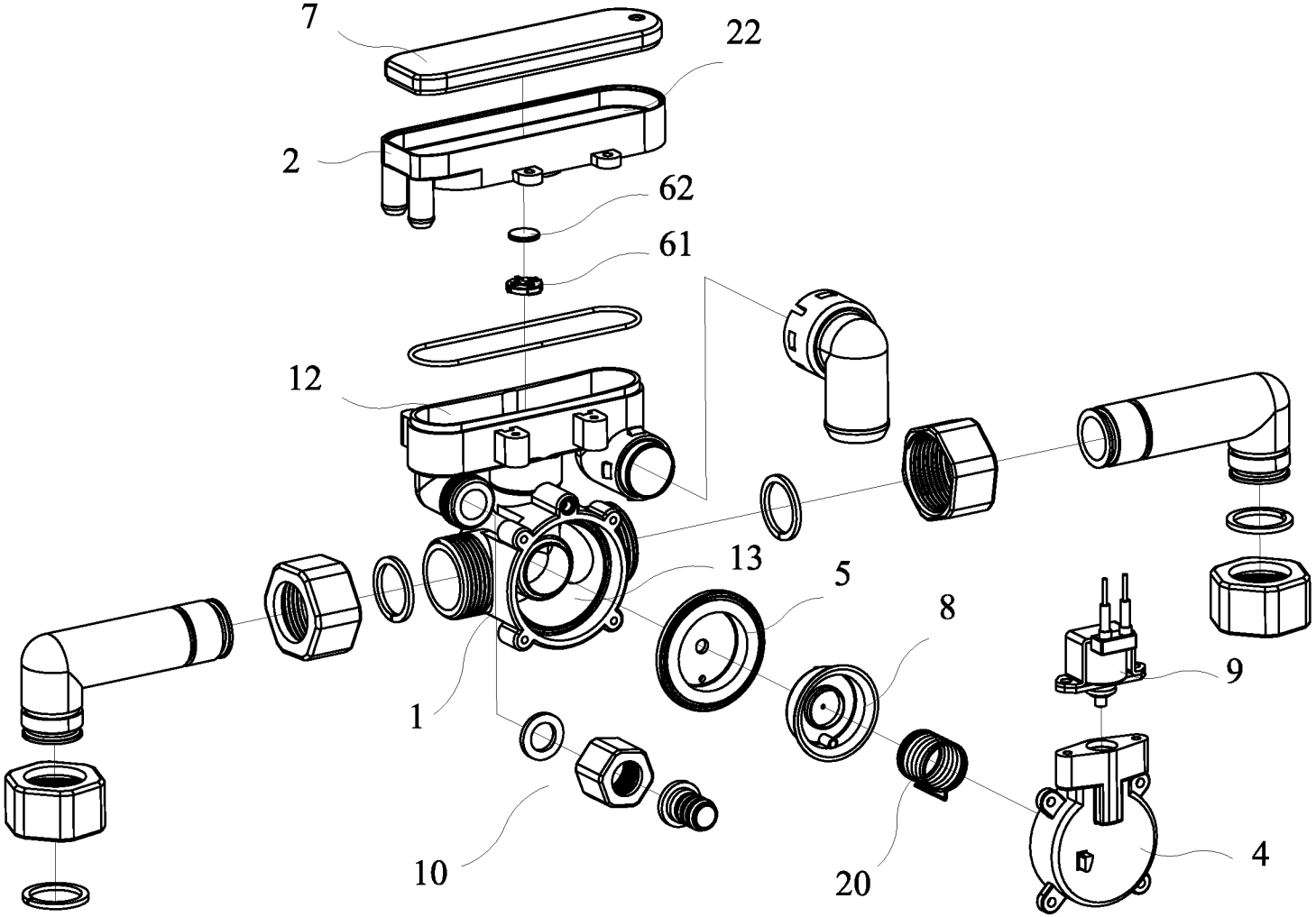
FIG. 14 is an exploded view of the third embodiment of the present invention.
Figure 15:
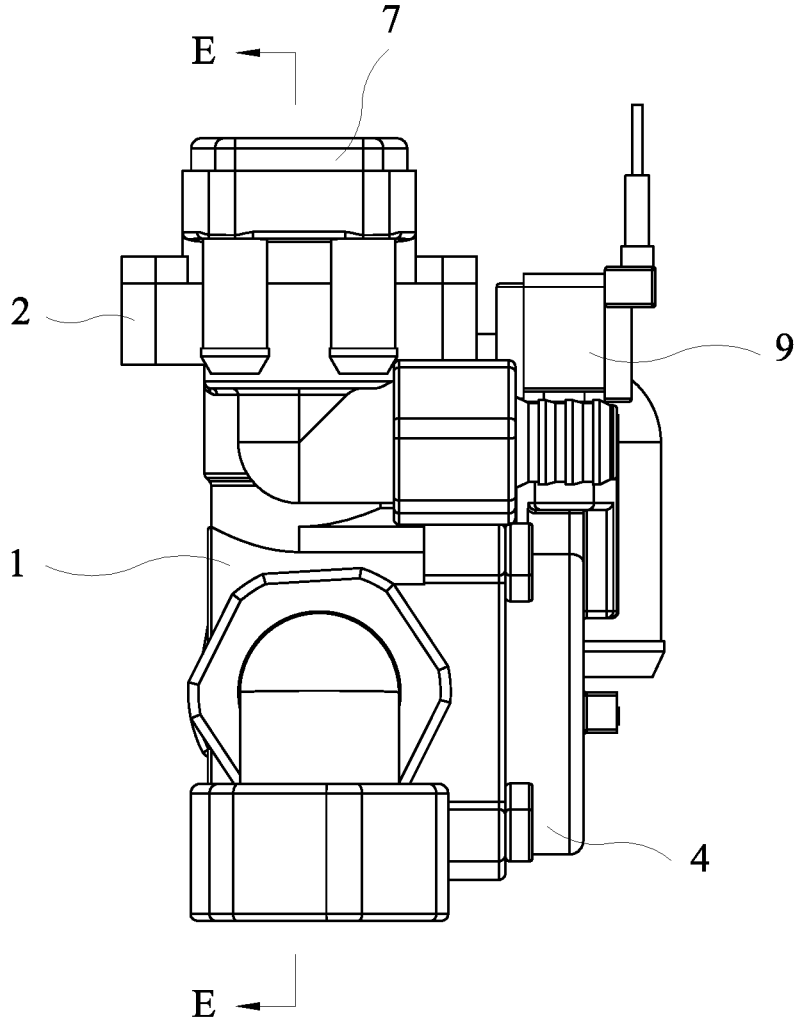
FIG. 15 is a side view of the third embodiment of the present invention.
Figure 16:
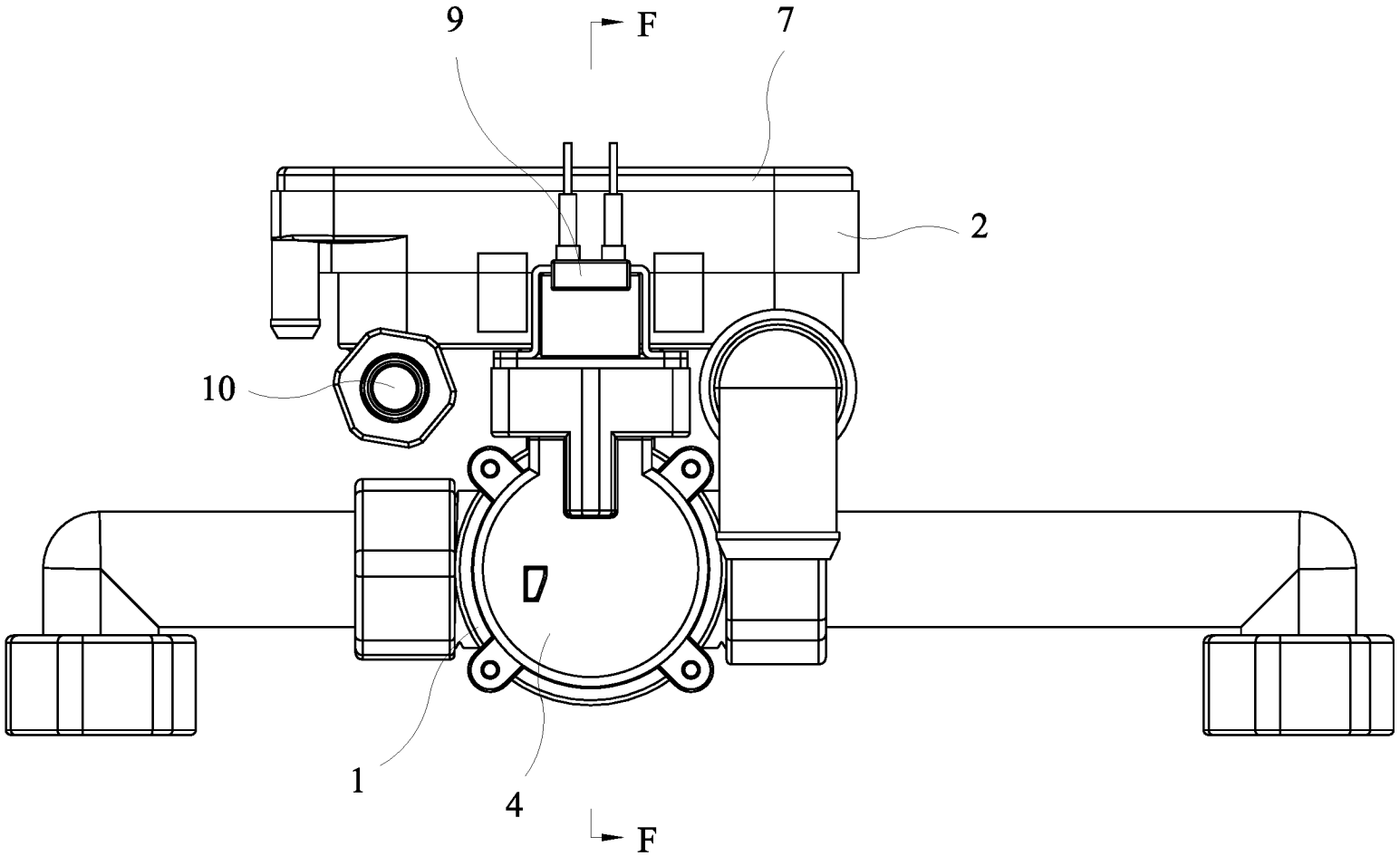
FIG. 16 is a front view of the third embodiment of the present invention.
Figure 17:
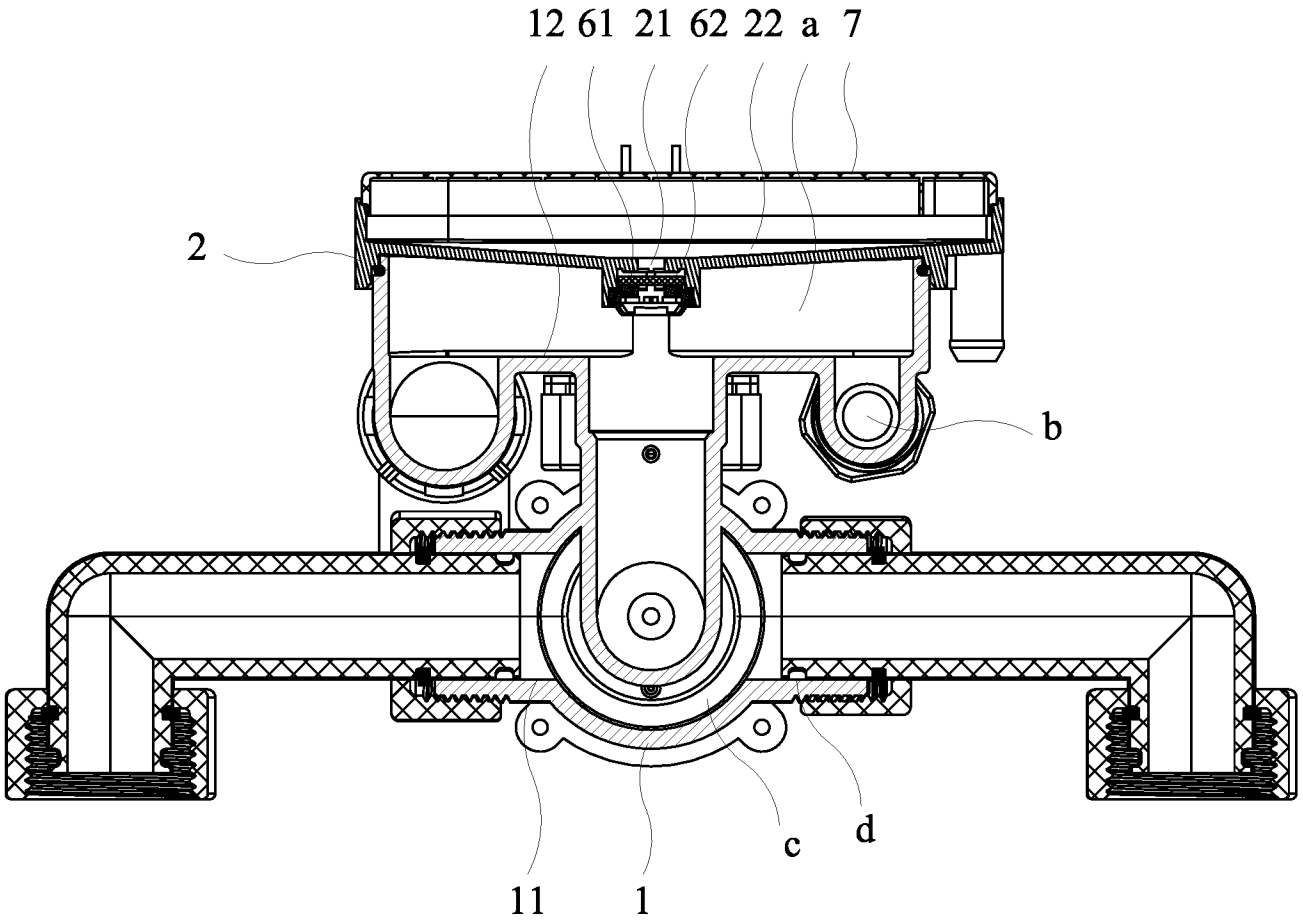
FIG. 17 is a cross-sectional view taken along line E-E of FIG. 15.
Figure 18:
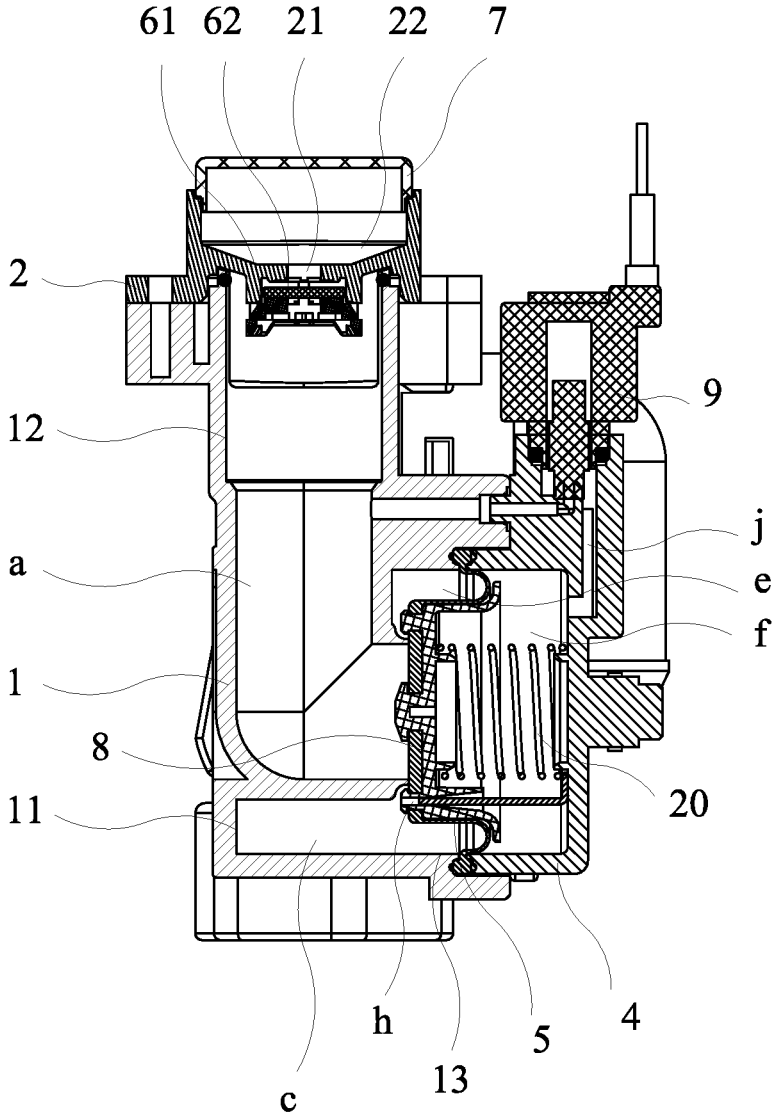
FIG. 18 is a cross-sectional view taken along line F-F of FIG. 16.

Referring to FIGS. 13 to 18, a third embodiment of the present invention is shown.

In the third embodiment, two drainage ports b are disposed on the main body 1, and the drainage port b is externally connected with a connector 10; two water filling ports d are disposed on the two sides of the main body 1, (the lower cover 3 is integrated with the main body 1), the water filling ports d are externally connected with the connector 10; only one drain port g defined as a second drain outlet j is disposed on the pressure relief cover 4. The second drain outlet j is controlled by the solenoid valve 9 of the pressure-assisted toilet flush system.

In the third embodiment, the connector 10 may have various shapes to realize the turning connection of the waterway according to the actual needs.

Although particular embodiments of the present invention have been described in detail for purposes of illustration, various modifications and enhancements may be made without departing from the spirit and scope of the present invention. Accordingly, the present invention is not to be limited except as by the appended claims

What is claimed is:

1. A drainage control device, comprising a main body, an upper cover, a lower cover, a pressure relief cover, a membrane and a return member;

the main body having a water filling trough, a drainage trough and a water passage trough, the water filling trough and the drainage trough being in communication with the water passage trough;

a drainage chamber being defined between the upper cover and the drainage trough, the drainage chamber having at least one drainage port;

a water filling chamber being defined between the lower cover and the water filling trough, the water filling chamber having at least one water filling port;

the pressure relief cover and the main body holding a periphery of the membrane;

a water passage chamber being defined between the membrane and the water passage trough, a back-pressure chamber being defined between the membrane and the pressure relief cover, the back-pressure chamber having at least one drain port, the membrane being deformable and configured to open or close a junction of the water passage chamber and the drainage chamber as a pressure in the back-pressure chamber varies;

the return member being disposed in the back-pressure chamber and configured to return the membrane to close the junction of the water passage chamber and the drainage chamber;

a water supplement channel being disposed between the back-pressure chamber and the water filling chamber for the back-pressure chamber to communicate with the water filling chamber.

2. The drainage control device as claimed in claim 1, wherein the upper cover has a vent for the drainage chamber to communicate with air.

3. The drainage control device as claimed in claim 2, further comprising a one-way valve assembly disposed in the vent, the one-way valve assembly being configured to open or close the vent.

4. The drainage control device as claimed in claim 3, wherein the one-way valve assembly includes a movable member and a sealing member, the movable member is movably inserted in the vent, and the sealing member is mounted on the movable member and configured to close the vent along with movement of the movable member.

5. The drainage control device as claimed in claim 3, wherein a top of the upper cover has an overflow trough, the vent communicates with the overflow trough, an opening of the overflow trough is provided with a lid, and the lid partially covers the opening of the overflow trough.

6. The drainage control device as claimed in claim 1, further comprising a movable seat for carrying the membrane, the return member being a spring disposed between the pressure relief cover and the movable seat; the pressure relief cover has an inner wall provided with an annular flange for positioning the spring.

7. The drainage control device as claimed in claim 6, wherein the movable seat has its surface provided with a plurality of retaining posts, the membrane is formed with retaining holes matching the retaining post, the retaining posts are inserted and positioned in the retaining holes; the water supplement channel passes through the membrane and the movable seat.

8. The drainage control device as claimed in claim 1, wherein the membrane is provided with at least one circle of deformable creases.

9. The drainage control device as claimed in claim 1, wherein the at least one drain port of the back-pressure chamber includes two drain ports, the two drain ports are respectively defined as a first drain outlet and a second drain outlet, the first drain outlet is controlled by a switch valve, and the second drain outlet is controlled by a solenoid valve.

10. The drainage control device as claimed in claim 9, wherein the second drain outlet is directly connected to the drainage chamber, and the solenoid valve is configured to control the second drain outlet to communicate with the discharge chamber or not.

11. The drainage control device as claimed in claim 1, wherein the drain port of the back-pressure chamber is defined as a first drain outlet, and the first drain outlet is controlled by a switch valve.

12. The drainage control device as claimed in claim 1, wherein the drain port of the back-pressure chamber is defined as a second drain outlet, and the second drain outlet is controlled by a solenoid valve.

13. The drainage control device as claimed in claim 12, wherein the second drain outlet is directly connected to the drainage chamber, and the solenoid valve is configured to control the second drain outlet to communicate with the discharge chamber or not.

* * * * *